US010906055B2

(12) United States Patent
Kim et al.

(10) Patent No.: US 10,906,055 B2
(45) Date of Patent: Feb. 2, 2021

(54) DEVICE FOR PACKAGING AND DISPENSING A PRODUCT COMPRISING A MOVEABLE PISTON

(71) Applicant: L'Oreal, Paris (FR)

(72) Inventors: Jin Seok Kim, Shanghai (CN); Vincent Jacquart, Shanghai (CN); Stéphane Leroux, Shanghai (CN)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 16/462,454

(22) PCT Filed: Nov. 28, 2016

(86) PCT No.: PCT/CN2016/107510
§ 371 (c)(1),
(2) Date: May 20, 2019

(87) PCT Pub. No.: WO2018/094740
PCT Pub. Date: May 31, 2018

(65) Prior Publication Data

US 2019/0321841 A1 Oct. 24, 2019

(51) Int. Cl.
*B05B 11/02* (2006.01)
*B05B 11/00* (2006.01)
(Continued)

(52) U.S. Cl.
CPC ..... *B05B 11/02* (2013.01); *B05B 11/0032* (2013.01); *B05B 11/06* (2013.01); *B65D 83/0005* (2013.01); *A45D 2200/055* (2013.01)

(58) Field of Classification Search
CPC ..... B05B 11/02; B05B 11/0032; B05B 11/06; B65D 83/0005; B65D 25/42; B65D 25/48;
(Continued)

(56) References Cited

U.S. PATENT DOCUMENTS 264,841 A * 9/1882 Poland ..... B65D 25/48 222/568
2,228,435 A * 1/1941 Binon ..... A47G 19/183 222/179.5
(Continued)

FOREIGN PATENT DOCUMENTS

EP 2153908 A1 2/2010
WO 2015000301 A1 1/2015
WO 2015053555 A1 4/2015

*Primary Examiner* — Patrick M. Buechner
*Assistant Examiner* — Michael J. Melaragno
(74) *Attorney, Agent, or Firm* — Christensen O'Connor Johnson Kindness PLLC

(57) ABSTRACT

The device for packaging and dispensing a product comprises a container (12), a moveable piston (16) mounted inside the container and delimiting at least one compartment (22) containing the product, and a dispensing member (14) mounted on the container and comprising at least one outlet orifice in communication with the compartment. The container comprises an adapter portion for the dispensing member provided with an outer skirt (12*d*) extending from an end wall (12*c*) of the container, with an inner skirt (12*e*) radially surrounded at least in part by the outer skirt and with a wall (12*f*) connecting the outer and inner skirts, the wall and the skirts delimiting a groove (30) oriented axially on the side opposite to the compartment (22) and inside which the dispensing member (14) is fitted.

11 Claims, 4 Drawing Sheets

Figure 1:
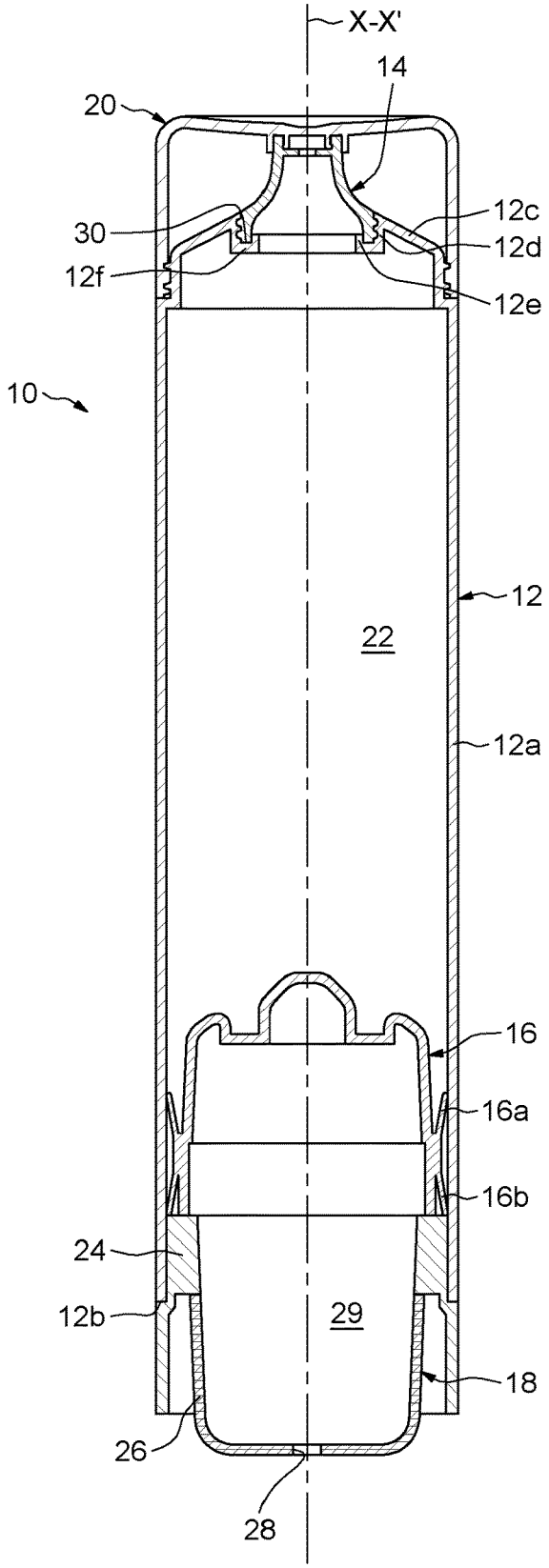

(51) Int. Cl.
*B05B 11/06* (2006.01)
*B65D 83/00* (2006.01)

(58) Field of Classification Search
CPC ..... B65D 83/28; B65D 25/40; B65D 5/746; A45D 2200/055
USPC .... 222/389, 209, 567, 568, 569, 570, 400.8, 222/401, 546, 552, 551, 566–70, 554
See application file for complete search history.

(56) References Cited

U.S. PATENT DOCUMENTS 2,329,917 A * 9/1943 Lautmann ..... B65D 83/0005 222/209
2,743,844 A * 5/1956 Livingstone ..... B65D 47/40 222/111
2,975,947 A * 3/1961 Pellett ..... B65D 47/128 222/546
3,275,200 A * 9/1966 Livingstone ..... B65D 83/64 222/389
3,351,249 A * 11/1967 Stull ..... B65D 47/242 222/520
3,381,863 A * 5/1968 Towns ..... B65D 83/64 222/386.5
3,827,607 A * 8/1974 Schultz ..... B65D 83/64 222/389
3,937,366 A * 2/1976 Steiman ..... B05B 11/0013 222/321.9
4,022,352 A * 5/1977 Pehr ..... B65D 47/0838 222/153.14
4,078,359 A 3/1978 Schultz
4,146,157 A * 3/1979 Dixon, Sr. ..... A47G 19/2272 220/703
4,171,757 A * 10/1979 Diamond ..... B65D 83/64 222/389
4,234,108 A * 11/1980 Diamond ..... B65D 83/64 222/386
4,284,213 A * 8/1981 Lee ..... B65D 47/10 220/266
4,362,255 A * 12/1982 Bond ..... B65D 75/5877 220/795
4,494,682 A * 1/1985 Beckstrom ..... B65D 47/123 222/551
4,877,156 A * 10/1989 Clanet ..... B65D 83/64 222/386.5
4,913,323 A * 4/1990 Scheindel ..... B65D 83/64 222/386
5,020,694 A * 6/1991 Pettengill ..... B65D 81/325 222/137
5,033,650 A * 7/1991 Colin ..... B05C 17/00506 222/137
5,330,083 A * 7/1994 Bartimes ..... B29C 57/04 222/546
5,577,641 A * 11/1996 De Laforcade ..... B29C 45/1676 222/386
5,779,107 A * 7/1998 French ..... B65D 83/0005 222/327
6,131,776 A * 10/2000 De Laforcade ..... B65D 83/64 222/387
6,230,943 B1 * 5/2001 Miyamoto ..... B65D 83/62 222/1
6,325,248 B1 * 12/2001 Corba ..... B65D 83/682 222/136
6,325,254 B1 * 12/2001 Diamond ..... B65D 83/64 222/386
6,439,440 B1 * 8/2002 Lasserre ..... B65D 83/205 222/288
6,446,880 B1 * 9/2002 Schram ..... B05B 17/0646 222/570
6,915,927 B2 * 7/2005 Stukas ..... B65D 47/123 222/189.06
7,175,057 B2 * 2/2007 Mutterle ..... B65D 47/18 215/256
7,624,897 B2 * 12/2009 Bloc ..... B05B 1/3431 222/207
7,677,422 B2 * 3/2010 Lee ..... B65D 41/0421 222/542
7,743,952 B2 * 6/2010 Auer ..... B65D 41/185 215/237
7,886,941 B2 * 2/2011 Pietrowski ..... B05B 11/007 222/494
8,297,480 B2 * 10/2012 Soon ..... B65D 83/0005 222/389
8,403,182 B2 * 3/2013 Lee ..... A47G 19/183 222/209
8,511,924 B2 * 8/2013 Bartolucci ..... B05C 17/00583 401/183
10,301,104 B2 * 5/2019 Smith ..... B65D 83/48
2003/0150888 A1 * 8/2003 Schneider ..... B65D 35/12 222/546
2004/0074923 A1 * 4/2004 Bang ..... B65D 83/0033 222/209
2005/0199655 A1 * 9/2005 Petit ..... A45D 33/02 222/546
2006/0043056 A1 * 3/2006 Lee ..... B65D 41/0421 215/344
2010/0155431 A1 * 6/2010 Bartolucci ..... B05C 17/00583 401/171
2010/0224657 A1 * 9/2010 Bowman ..... A61F 9/0008 222/420
2010/0327023 A1 * 12/2010 Lee ..... A47G 19/183 222/209
2011/0024452 A1 * 2/2011 Moretti ..... B05B 11/0054 222/105
2014/0048568 A1 * 2/2014 Demey ..... B65D 83/202 222/402.22
2015/0253312 A1 * 9/2015 Awdeh ..... C12Q 1/04 436/164
2015/0353245 A1 * 12/2015 Sakimura ..... B65D 47/20 222/545

* cited by examiner

DEVICE FOR PACKAGING AND DISPENSING A PRODUCT COMPRISING A MOVEABLE PISTON

The present invention relates to the general field of devices for packaging and dispensing a liquid, a semi-liquid or a pasty product.

More particularly, the present invention relates to a device comprising a container and a moveable piston disposed inside said container and delimiting at least one compartment inside which is housed the product to be dispensed.

According to a first known design, the container is divided into first and second compartments by the movable piston. The product to be dispensed is contained within one of the compartments, while the other compartment is filled with a gas under pressure.

With such a design, when the dispensing member such as a valve is open, the gas under pressure moves the piston against the product to be dispensed and causes said product to be discharged through an outlet orifice of the dispensing member. For example, such device is disclosed in U.S. Pat. No. 4,078,359.

According to a second known design, the device comprises an air pump which is mounted on the container at the side opposite to the dispensing member and provided with an air inlet. When the user recovers the air inlet and presses the air pump, this produces a displacement of the piston against the product to be dispensed. For more details, it is possible for example to refer to the U.S. Pat. No. 8,403,182.

The filling operation of the container of such devices can be either a back filling operation or a top filling operation.

In a back filling operation, the device is disposed in an inverted orientation with the dispensing member located below the container. A predetermined quantity of product to be dispensed is discharged into the container through an open end of said container. Then, the piston is pushed into the container through said open end until it engages the product. Such a mounting of the piston generally leads to pressurisation problems of the product.

This drawback is overcome by a top filling operation wherein the piston is firstly placed within the container and then the product is discharged into the container. Once the predetermined quantity of product has been discharged, the top end of the container is closed by a wall and the dispensing member is mounted on such closing wall, for example by crimping.

However, with respect to a back filling operation, a top filling operation requires an additional assembly step and also an additional part for closing off the container. This leads to a reduction in production rates.

It is a particular object of the present invention to provide a device having a moveable piston whose manufacture and mounting are easily carried out at a lesser cost.

Another object of the present invention is to provide a device having good sealing properties between the dispensing member and the container.

The invention relates to a device for packaging and dispensing a product comprising a container, a moveable piston mounted inside the container and delimiting at least one compartment containing the product, and a dispensing member mounted on the container and comprising at least one outlet orifice in communication with the compartment.

According to a first general feature, the container comprises an adapter portion for the dispensing member. Such adapter portion is provided with an outer skirt extending from an end wall of said container, with an inner skirt radially surrounded at least in part by said outer skirt, and with a wall connecting the outer and inner skirts.

According to a second general feature, the inner and outer skirts delimit together with the connecting wall a groove oriented axially on the side opposite to said compartment. The dispensing member is fitted inside said groove.

With the specific design of the container, the mounting of the dispensing member can be easily achieved in one single step. The provision of the groove on the container reduces manufacturing time and costs. Otherwise, with the groove delimited by the inner and outer axial skirts and the connecting wall, the dispensing member is mounted on the container in a leaktight manner. A possible leakage of product between the dispensing member and the container is prevented.

In one embodiment, the groove may be in cross-section a U-shape.

Preferably, at least one retaining element is provided on the outer skirt, or on the inner skirt, of the adapter portion of the container and cooperates with at least one retaining element of complementary shape of the dispensing member for axially retaining said dispensing member on said container. The device may be transported and handled with complete safety without any risk of loss of the dispensing member.

Alternatively, it could however be possible, instead of retaining elements, to provide a radial press-fitting the between dispensing member and at least one of the outer and inner skirts of the container.

In one embodiment, the outer or inner skirt of the adapter portion comprises at least one annular recess and the dispensing member comprises at least one annular clipping rib engaging into said recess. Alternatively, it could be possible to provide an inverted arrangement with said at least one annular recess provided on the dispensing member and said at least one annular clipping rib provided on the inner or outer skirt of the adapter portion.

Accordingly, the mounting of the dispensing member into the groove can be achieved with a simple axial pushing movement.

In another embodiment, the inner or outer skirt of the adapter portion may comprise at least one annular screw groove and the dispensing member may comprise a screw thread engaging into said screw groove. In another variant, it is also possible to provide an inverted arrangement.

Here, the mounting of the dispensing member is obtained by screwing instead of snap-fitting.

Preferably, the outer skirt of the adapter portion extends from the end wall of the container axially inside the compartment. Such a design promotes the axial compactness of the container. Besides, the container is easier to manufacture.

In order to facilitate the production of the device, at least the end wall and the adapter portion of the container may be made in one part. This further reduces manufacturing time and costs since the number of parts as well as the assembly steps are limited.

The dispensing member may comprise a sealing lip engaging into the inner skirt of the container in a leaktight manner.

In one embodiment, the device further comprises a cap mounted on the container for closing off the outlet orifice of the dispensing member.

Advantageously, the cap comprises an inner sealing skirt engaging into the outlet orifice. This prevents leakage of product between the dispensing member and the cap. To this end, the cap may also comprise an outer sealing skirt radially coming into contact with an outer surface of the dispensing member.

In order to secure the cap on the dispensing member, the inner sealing skirt may comprise at least one hook extending radially and engaging into a groove formed on the dispensing member. Alternatively or in combination, the outer sealing skirt may also comprise such hook(s).

Otherwise, the device may comprise an actuating member for delivering the product through the outlet orifice of the dispensing member in response to an actuating command.

Preferably, the actuating member comprises an air pump mounted on the container axially on the side opposite to the dispensing member. Said air pump and the piston axially delimit a chamber which is separate from the compartment and which is in communication with the outside.

Alternatively, it is also possible to mount the actuating member on the dispensing member. In another variant, the actuating member may be formed by said dispensing member. In such cases, the piston delimits inside the container an additional compartment separate from the compartment containing the product to be dispensed, said additional compartment containing a propellant gas capable of pressurizing said product via said piston.

Figure 2:
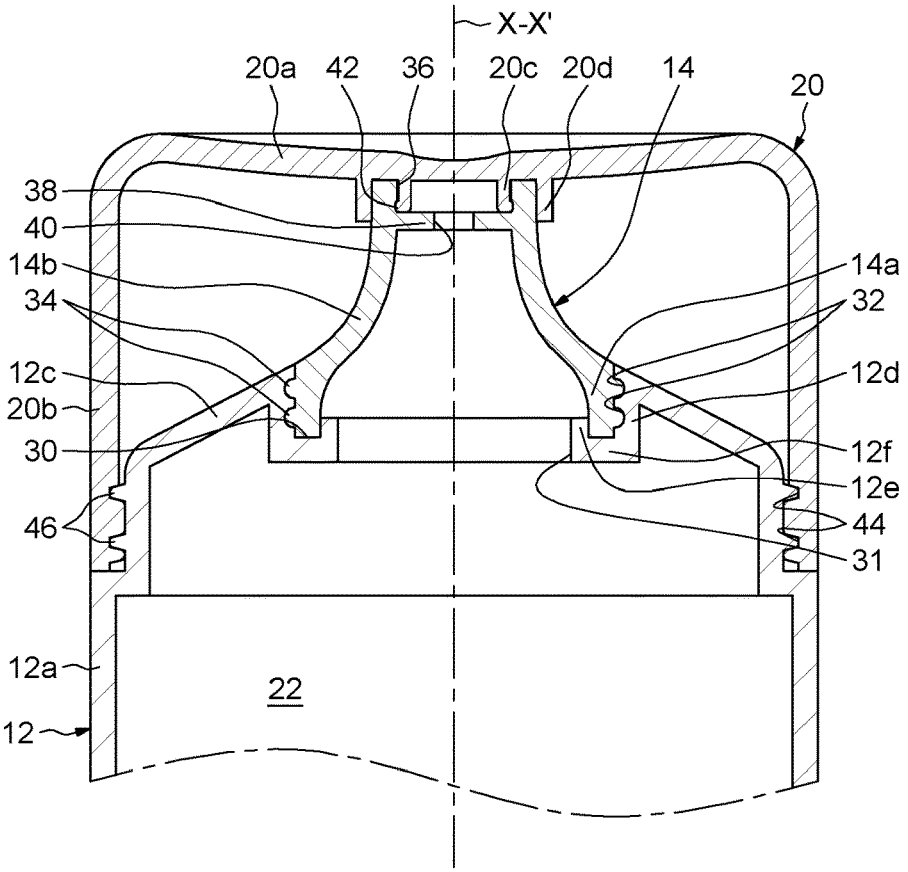
Figure 3:
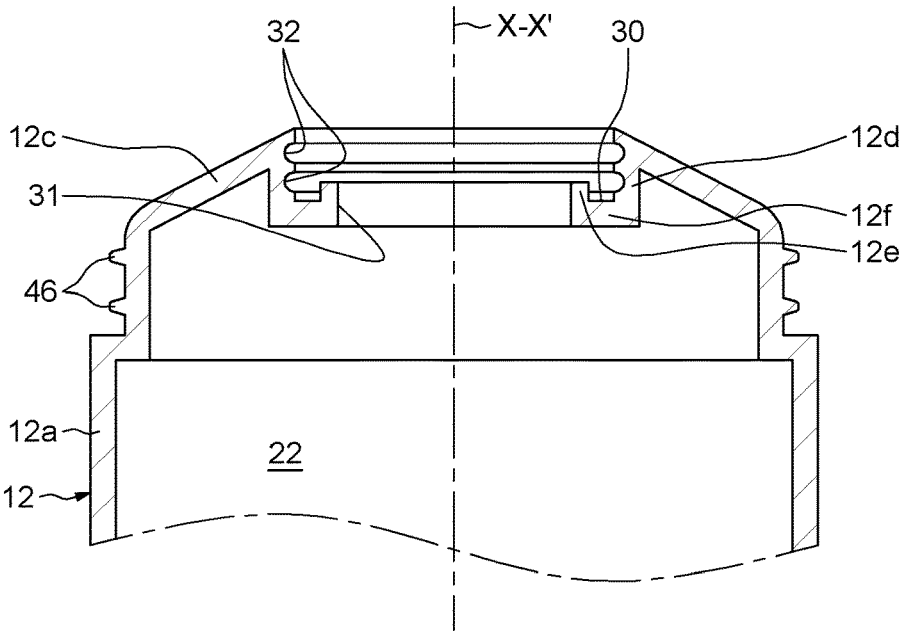
Figure 4:
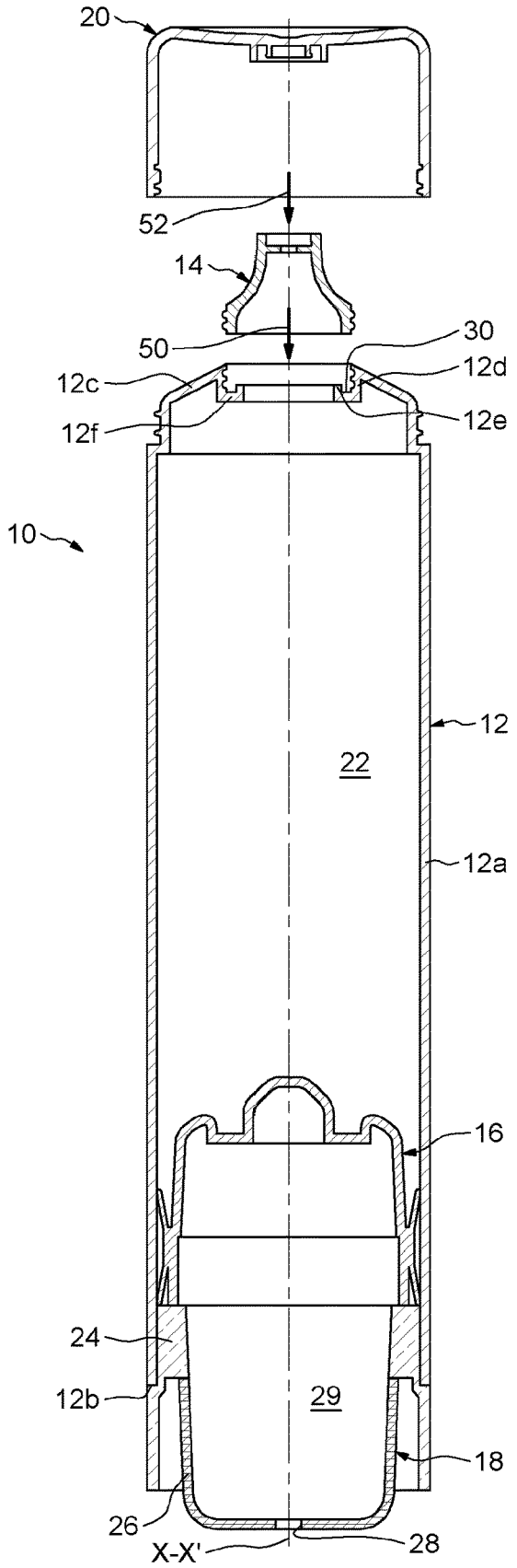
Figure 5:
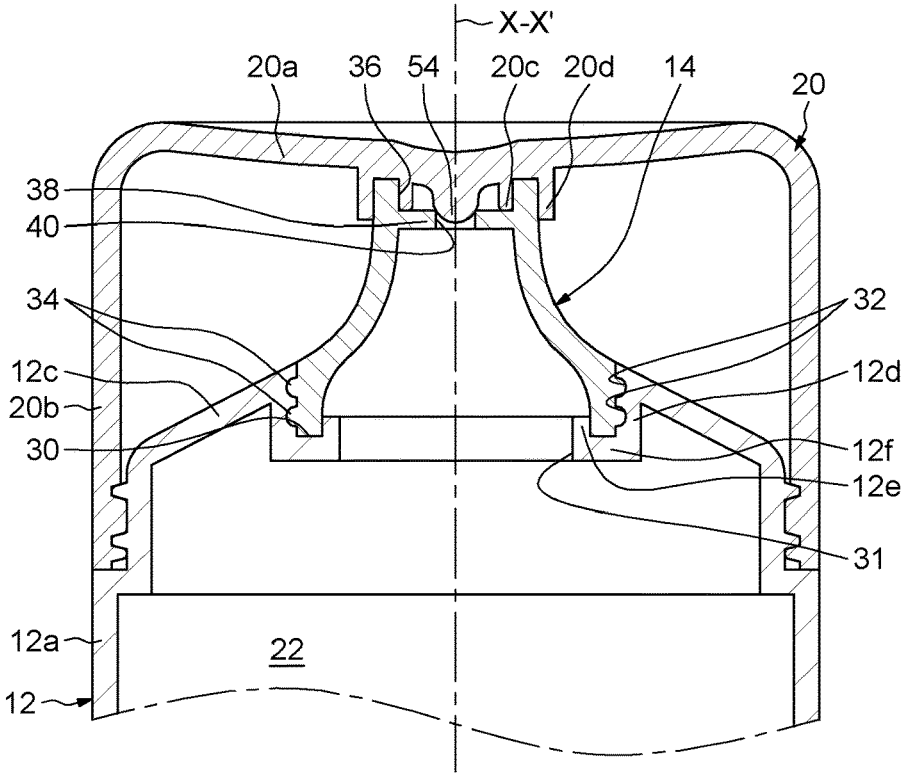
Figure 6:
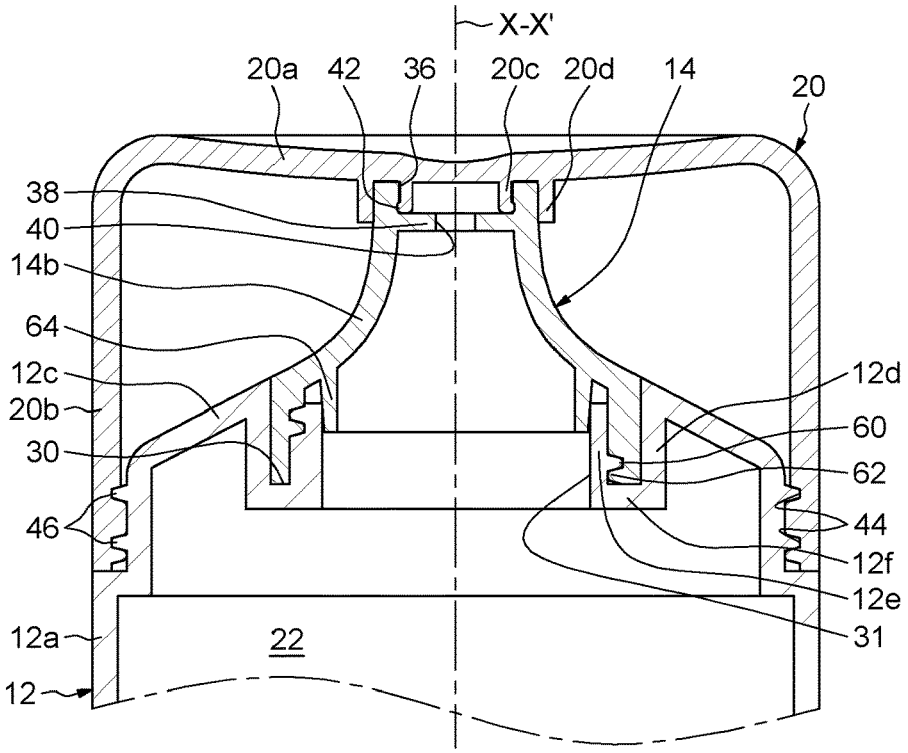

The present invention and its advantages will be better understood by studying the detailed description of specific embodiments given by way of a non-limiting examples and illustrated by the appended drawings on which:

FIG. 1 is a cross-section of a device according to a first example of the invention, FIG. 2 is a detail view of FIG. 1, FIG. 3 is a detail view of a container of the device of FIG. 1, FIG. 4 is an exploded view of the device of FIG. 1, FIG. 5 is a detail view of a device according to a second example of the invention, and FIG. 6 is a detail view of a device according to a third example of the invention.

FIG. 1 shows an example of a device, denoted by the general reference number 10, for packaging and dispensing a product (not shown) for example a liquid, a semi-liquid or a pasty cosmetic product. The device 10 may also be used for packaging other types of products.

FIG. 1 represents the device 10 in a state that is assumed to be vertical. The device 10 has a longitudinal axis X-X'. The device 10 comprises a container 12, a dispensing plug 14 mounted on the container, a movable piston 16 mounted inside the container, and an air pump 18 axially mounted on said container on the side opposite to the dispensing plug 14 with respect to the piston 18. The device 10 further comprises a closure cap 20 mounted on the container 12 for closing off the dispensing plug 14.

As will be described later, the structure of the container 12 is adapted for receiving the dispensing plug 14 in a leaktight manner.

The piston 16 is mounted axially slidably into the container 12 along the axis X-X'. The piston 16 delimits inside the container a compartment 22 containing the product to be dispensed under pressure. The compartment 22 which contains the product is in communication with the dispensing plug 14.

The piston 16 bears against the inner surface of a peripheral wall 12*a* of the container. To this end, in the illustrated example, the piston 16 comprises two friction sealing lips 16*a*, 16*b* coming into friction contact the peripheral wall 12*a* of the container. The lips 16*a*, 16*b* extend in opposite direction. The lip 16*a*, which extends axially on the side of the dispensing plug 14, acts as a scraper lip during an upward movement of the piston 16. The lip 16*b*, which extends axially on the side of the air pump 18, is adapted to prevent any inlet of air into the compartment 22 through said air pump. The piston 16 fits inside the container 12 in a leaktight manner while maintaining its freedom to slide.

In the illustrated example, the profile of the piston 16 is chosen appropriately so as to optimize the degree to which the container 12 is emptied. For example, the upper end of piston 16 is contoured to complement the upper end of the container 12 so as to minimize the volume of the compartment 22 when the piston 16 is located at its uppermost position, adjacent to the dispensing plug 14. Alternatively, the piston 16 may have a different shape, for example cylindrical.

The container 12 extends along the axis X-X'. The container 12 comprises a bottom end 12*b* delimiting an opening which is closed by the air pump 18, an upper end wall 12*c* axially opposite to the bottom end 12*b*, and the peripheral wall 12*a* extending axially between said bottom end and upper end wall. The compartment 22 is axially delimited by the piston 16 and the end wall 12*c* of the container.

The air pump 18 comprising a mounting part 24 secured to the bottom end 12*b* of the container, and a push-button 26 connected to said mounting part for delivering a dose of product in response to an actuating command. The push-button 26 is provided with a through-opening providing an air inlet orifice 28. The push-button 26 delimits together with the piston 16 a chamber 29 in communication with the outside. The chamber 29 is separate from the compartment 22 by the piston 16. The chamber 29 may be delimited by the push-button 26, the piston 16 and also the container 12 depending on the position of said piston. When no pressure is exerted on the push-button 26, the chamber 29 is substantially at atmospheric pressure.

Once the cap 20 has been removed, to distribute the product contained into the chamber 22 the user recovers the inlet orifice 28 with one finger and exerts an axial pressure inwards on the push-button 26. This produces an increase of the pressure within the chamber 29, thereby moving the piston 16 against the product to be dispensed. Accordingly, the product is discharged through the dispensing plug 14. In the disclosed example, the push-button 26 is made in a resilient material, such as rubber, to be elastically deformable. Alternatively, the push-button 26 may be provided with an elastic element, such as a spring, in order to be able to return to its initial position when the pressure exerted by the user ceases.

As shown more clearly on FIGS. 2 and 3, the container 12 also comprises an annular outer skirt 12*d* extending from the end wall 12*c* axially inside the compartment 22, an annular inner skirt 12*e* and a wall 12*f* connecting said outer and inner skirts. The skirts 12*d*, 12*e* and the wall 12*f* delimit a groove 30 oriented axially on the side opposite to the compartment 22. The groove 30 is oriented axially outwards. Here, the groove 30 has in cross-section a U-shape. The dispensing plug 14 is fitted into the groove 30. The skirts 12*d*, 12*e* and the wall 12*f* form an adapter portion for the mounting of the dispensing plug 14 on the container. The container 12 is made in one part. For example the container 12 may be made from moulding of plastic material. Alternatively, the container 12 may be made in metallic material.

The outer skirt 12*d* of the container extends axially inside the compartment 22 and radially surrounds the inner skirt 12*e*. The wall 12*f* extends from a lower end of the outer skirt 12*d*. The wall 12*f* extends radially. The wall 12*f* is extended at a small-diameter edge by the inner skirt 12*e*. The inner skirt 12*e* extends axially on the side opposite to the compartment 22. The inner skirt 12*e* delimits on opening 31 in communication with the compartment 22. The outer and inner skirts 12*d*, 12*e* are coaxial with the axis 12*a*.

The dispensing plug 14 projects into and sealingly engages the groove 30 of the container. This prevents leakage of product contained inside the compartment 22. The plug 14 is in radial contact against the inner skirt 12*e* on one side and in radial contact with the outer skirt 12*f* on the other side. In the disclosed example, the groove 30 has an annular form. Alternatively, it could be possible to foresee a groove with a different shape, for example a square or a rectangular one, according to the shape of the dispensing plug 14.

In the illustrated example, annular recesses 32 are formed on the inner surface of the outer skirt 12*d* of the container into which engage complementary annular clipping ribs 34 of the dispensing plug in order to secure said plug on the container by snap-fitting. The recesses 32 form retaining elements cooperating with complementary axial retaining elements formed by ribs 34 to fix the plug 14 to the container. In the illustrated example, the outer skirt 12*d* of the container is provided with two recesses 32. Alternatively, the outer skirt 12*d* may comprise a single recess or more than two recesses. In another variant, it could also be possible to foresee on the outer skirt 12*d* an annular screw groove into which a screw thread of the dispensing plug.

The dispensing plug 14, coaxial with the axis X-X', comprises an assembly base 14*a* engaged inside the groove 30 of the container and provided with the ribs 34, and a nozzle 14*b* extending axially said base. In the illustrated example, the nozzle 14*b* presents a conical shape that converges upwards. The nozzle 14*b* delimits a dispensing or outlet orifice 36 in fluidly communication with the compartment 22 of the container. The outlet orifice 36 is delimited by the upper end of the nozzle 14*b*. The dispensing plug 14 has a hollow shape. The plug 14 is made in one part, for example from plastic material, for example polyethylene (PE), polypropylene (PP), polyethylene terephthalate glycol-modified (PETG), etc.

In the illustrated example, the dispensing plug 14 further comprises, near to the outlet orifice 36, an inner wall 38 extending radially inwards from the nozzle 14*b* and provided with a through-hole 40. Alternatively, it could be possible to foresee a dispensing plug 14 deprived of such inner wall 38.

The cap 20 comprises a top wall 20*a* and an annular peripheral skirt 20*b* extending axially said top wall towards the container 12. The skirt 20*b*, coaxial with the axis X-X', extends a large-diameter of the top wall 20*a*. The skirt 20*b* axially abuts against a radial shoulder (not referenced) formed between the peripheral wall 12*a* and the end wall 12*c* of the container.

The cap 20 also comprises an inner annular sealing skirt 20*c* projecting axially from the top wall 20*a* and which engages into the outlet orifice 36 of the dispensing member. The inner sealing skirt 20*c* fits into the outlet orifice 36 to close it in a sealed manner. The inner sealing skirt 20*c* is in radial contact with the inner surface of the dispensing plug 14.

The cap 20 further comprises an outer annular sealing skirt 20*d* projecting axially from the top wall 20*a* and which radially surrounds the inner sealing skirt 20*c*. The outer sealing skirt 20*d* is in radial contact with the outer surface of the dispensing plug 14. The outer sealing skirt 20*d* is sealingly engaged around the dispensing plug 14. The inner and outer sealing skirts 20*c*, 20*d* are disposed in a concentric manner about the axis X-X'

In order to secure the cap 20 on the dispensing plug 14, the inner sealing skirt 20*c* is provided with an annular hook 42 extending radially outwards and engaged into an annular groove (not referenced) formed on the inner surface of the dispensing plug 14. The hook 42 is formed on the outer surface of the inner sealing skirt 20*c*. Here, the hook 42 is provided at the free end of the skirt 20*c*.

Alternatively, the inner sealing skirt 20*c* may comprise a plurality of hooks spaced apart one relative to another in the circumferential direction instead of the annular hook. In another variant, it could be possible to provide hook(s) on the bore of the outer sealing skirt 20*d* engaging into a groove formed on the outer surface of the plug 14. However, with such a design, once the cap 20 is removed, said groove is visible from the outside.

To increase the holding of the cap 20 on the dispensing plug 14, the inner diameter of the outer sealing skirt 20*d* is adapted to obtain a radial interference fit between said skirt and the outer surface of the dispensing plug 14. In the illustrated example, for the axial retention of the cap 20 on the container 12, the peripheral skirt 20*b* of the cap is also provided internally with grooves 44 into which engage annular clipping ribs 46 provided on the container near to the radial shoulder. The cap 20 is made in one part, for example made from moulding of plastic material.

Concerning the filling of the container 12, the product to be dispensed may be introduced into the compartment 22 with a top filling operation. Once the product is introduced via the opening 31 delimited by the inner skirt 12*e* of the container, the mounting of the dispensing plug 14 can be easily achieved with a simple axial pushing movement into the groove 30 as illustrated schematically on FIG. 4 by the arrow referenced 50. The mounting of the dispensing plug 14 is achieved without angular indexation. Then, the cap 20 is mounted on the plug 14 in a similar way, by an axial pushing movement illustrated by the arrow 52. Alternatively, it could be possible to assemble together the plug 14 and the cap 20 in a first operation, and then to mount such unitary assembly on the container 12 by one axial pushing.

In the second example illustrated on FIG. 5, in which identical parts are given identical references, the cap 20 of the device differs in that it further comprises a sealing stud 54 projecting axially from the top wall 20*a* and which engages into the through-hole 40 of the dispensing member. The stud 54 is coaxial with the axis X-X'. In this example, the inner sealing skirt 20*c* of the cap is deprived of hook. Alternatively, it is possible to provide hook(s) on the cap as described in the first example.

The third example illustrated on FIG. 6, in which identical parts are given identical references, differs from the first example in that the inner skirt 12*e* of the container comprises on its outer surface a screw thread 60 cooperating with a complementary screw thread 62 formed on the bore of the assembly base 14*a* of the dispensing plug in order to secure said plug on the container. Alternatively, to axially secure the dispensing plug 14, it could be possible to foresee on the outer surface of the inner skirt 12*e* annular recesses into which engage complementary annular clipping ribs formed on the bore of the plug 14 as previously described in the first example. In this example, the outer and inner skirts 12*d*, 12*e* have an elongated length.

The dispensing plug 14 further comprises an annular sealing lip 64 engaging into the opening 31 of the inner skirt 12*e*. The lip 64 comes into radial contact with said opening 31 and thus engages the inner skirt 12*e* in a leaktight manner. The lip 64 extends from the nozzle 14*b* of the plug.

Although the invention has been illustrated on the basis of an assembly comprising an air pump mounted on the container on the side opposite to the dispensing member, it should be understood that the invention also applies to a container comprising a propellant gas introduced into a second compartment delimited by the piston and a bottom end of said container. In this case, the dispensing member may comprise a valve equipped with a push-button in order to permit the product to be expelled outside.

The invention claimed is:

1. Device for packaging and dispensing a product comprising a container, a moveable piston mounted inside the container and delimiting at least one compartment containing the product, and a dispensing member mounted on the container and comprising at least one outlet orifice in communication with the compartment, wherein the container comprises an adapter portion for the dispensing member provided with an outer skirt extending from an end wall of said container, with an inner skirt radially surrounded at least in part by said outer skirt and with a wall connecting the outer and inner skirts, wherein the compartment is axially delimited by the piston and the end wall of the container, wherein the outer skirt of the adapter portion is provided with a lower end, and with an upper end which is connected to the end wall of the container, wherein the outer skirt extends axially inside the compartment towards the piston and is entirely located inside the compartment, wherein the connecting wall of the adapter portion, from which is issued the inner skirt, extends from the lower end of the outer skirt which is located inside the compartment, and wherein said connecting wall and said skirts delimiting a groove oriented axially on the side opposite to said compartment and inside which the dispensing member is fitted.

2. Device according to claim 1, wherein the groove has in cross-section a U-shape.

3. Device according to claim 1, wherein at least one retaining element is provided on the outer skirt, or on the inner skirt, of the adapter portion of the container and cooperates with at least one retaining element of complementary shape of the dispensing member for axially retaining said dispensing member on said container.

4. Device according to claim 3, wherein one of said retaining elements comprises an annular recess, the other of said retaining elements comprising an annular clipping rib engaging into said recess.

5. Device according to claim 3, wherein one of said retaining elements comprises an annular screw groove, the other of said retaining elements comprising a screw thread engaging into said screw groove.

6. Device according to claim 1, wherein the dispensing member comprises a sealing lip engaging into the inner skirt of the container in a leaktight manner.

7. Device according to claim 1, further comprising a cap mounted on the container for closing off the outlet orifice of the dispensing member.

8. Device according to claim 7, wherein the cap comprises an inner sealing skirt which engages into the outlet orifice.

9. Device according to claim 8, wherein the inner sealing skirt comprises at least one hook extending radially and engaging into a groove formed on the dispensing member.

10. Device according to claim 1, comprising an actuating member for delivering the product through the outlet orifice of the dispensing member in response to an actuating command.

11. Device according to claim 10, wherein the actuating member comprises an air pump mounted on the container axially on the side opposite to the dispensing member, said air pump and the piston axially delimiting a chamber separate from the compartment and in communication with the outside.

* * * * *